US006074233A

United States Patent [19]

Lin

[11] Patent Number: 6,074,233

[45] Date of Patent: Jun. 13, 2000

[54] TERMINAL FOR A CPU CONNECTOR

[75] Inventor: Jack Lin, 1F, No. 292, Min-Tsu Rd., Lu-Chou Shiang, Taipei Hsien, Taiwan

[73] Assignee: Jack Lin, Taipei Hsien, Taiwan

[21] Appl. No.: 09/291,217

[22] Filed: Apr. 14, 1999

[51] Int. Cl.[7] ..... H01R 4/50; H01R 13/625

[52] U.S. Cl. ..... 439/342

[58] Field of Search ..... 439/342, 259, 439/856, 858

[56] References Cited

U.S. PATENT DOCUMENTS 5,454,727 10/1995 Hsu ..... 439/342

*Primary Examiner*—Khiem Nguyen
*Assistant Examiner*—Javaid Nasri
*Attorney, Agent, or Firm*—Fei-Fei Chao; Venable, Baetjer, Howard & Civiletti, LLP

[57] ABSTRACT

A terminal installed in one terminal slot at a substrate of a CPU connector for receiving a pin of a CPU mounted on the CPU connector, the terminal having three side wings for positioning in the terminal slot in the substrate of the CPU connector to stop terminal against vibration, two supporting arms, and three guide portions for guiding the pin of the CPU into the space defined between the supporting arms, enabling the pin of the CPU to be firmly retained between a raised portion at one supporting arm and a recessed guide face at one guide portion at the other supporting arm.

1 Claim, 4 Drawing Sheets

TERMINAL FOR A CPU CONNECTOR

BACKGROUND OF THE INVENTION

The present invention relates to a terminal for a CPU connector, and more particularly to such a terminal which comprises three side wings for positioning in one terminal slot in the substrate of the CPU connector, two supporting arms, and three guide portions for guiding the corresponding pin of a CPU into contact with the terminal between the supporting arms.

FIG. 6 shows a terminal 40 for a CPU connector according to the prior art. This structure of terminal 40 comprises a mounting base 41, a leg 412 and a supporting arm 411 respectively extended from bottom and top sides of the mounting base 41 in reversed directions, two ribs 42 and 43 perpendicularly raised from two opposite lateral sides of the mounting base 41, two springy retainer arms 421 and 431 upwardly inwardly raised from the ribs 42 and 43 toward each other and terminating in a respective smoothly curved guide portion 422 and 432. When the terminal 40 is inserted into one terminal slot at the substrate of the CPU connector (not shown), the terminal 40 may be tilted due to manufacturing tolerance of the terminal and the terminal slot at the substrate of the CPU connector, causing the terminal 40 unable to be firmly secured in position. Further, when the corresponding pin 50 of the CPU which is mounted on the CPU connector is inserted into the contact with the terminal 40, the springy retainer arms 421 and 431 are forced by the pin 50 to turn the guide portions 422 and 432 outwards, and only the connecting area between the springy retainer arms 421 and 431 and the guide portions 422 and 432 is maintained in contact with the periphery of the pin 50 (see FIG. 6). This limited contact area is not sufficient to hold the pin 50 in position. Further, if the pin 50 is tilted in one direction during its installation, much friction resistance is produced, and much effort should be employed to set the pin 50 in position.

SUMMARY OF THE INVENTION

The present invention provides a terminal for a CPU connector which eliminates the aforesaid drawbacks. According to one aspect of the present invention, the terminal is installed in one terminal slot at a substrate of a CPU connector for receiving a pin of a CPU mounted on a cover plate of the CPU connector at the top side of the substrate, comprising three side wings for positioning in the terminal slot in the substrate of the CPU connector to stop terminal against vibration. The three side wings prevents the terminal from deformation during its shape-forming process. According to another aspect of the present invention, the terminal further comprises first and second supporting arms, and three guide portions for guiding the pin of the CPU into the space defined between the supporting arms, enabling the pin of the CPU to be firmly retained between the supporting arms. According to another aspect of the present invention, a spring strip is raised from a part of the terminal and suspended between the supporting arms, and compressed to impart a reactive force to the pin of the CPU upon insertion of the pin into contact with the terminal, causing the pin to be held down against vibration. According to still another aspect of the present invention, the first supporting arm is provided with a raised portion facing the second supporting arm, and a recessed guide face is provided at one guide portion at the second supporting arm for guiding the pin of the CPU into position and pressing the periphery of the pin against the raised portion at the first supporting arm to minimize friction resistance between the terminal and the pin of the CPU during installation of the pin.

DETAILED DESCRIPTION OF THE PREFERRED EMBODIMENT

Figure 2:
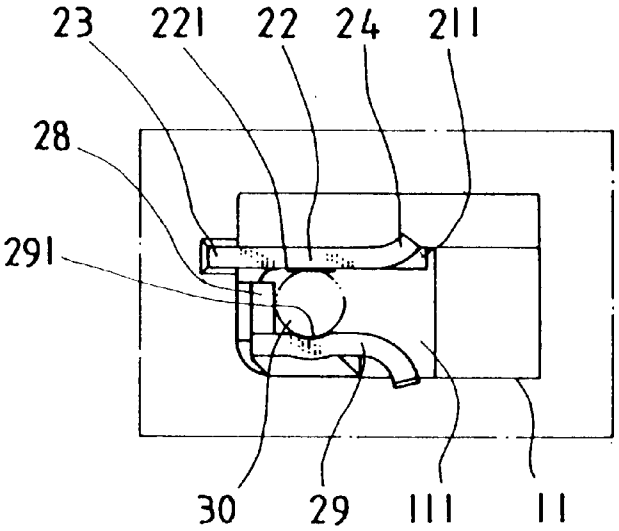
FIG. 2 is a top view showing the terminal installed in the terminal slot at the substrate, the corresponding pin of the CPU retained to the terminal.

Referring to FIGS. from 1 through 3, a CPU connector 10 is shown comprised of a substrate 11, a cover plate 12, and a lever 13 pivoted to the substrate 11 and turned to move the cover plate 12 relative to the substrate 11. The substrate 11 comprises a plurality of terminal slots 111 corresponding to respective insertion slots 121 at the cover plate 12, and a plurality of terminals 20 respectively mounted in the terminal slots 111.

Figure 1:
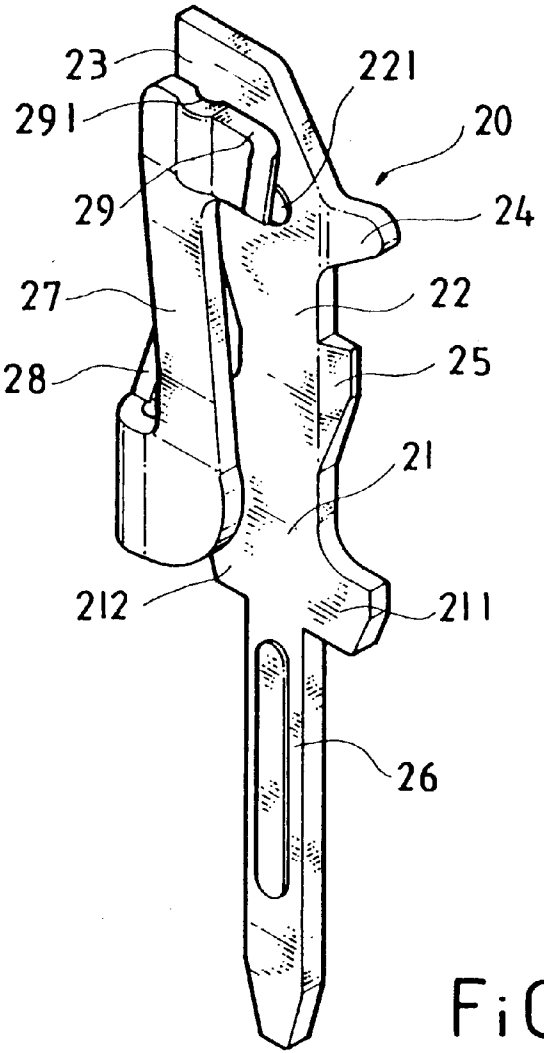
FIG. 1 is a perspective view of a terminal for a CPU connector according to the present invention.
Figure 3:
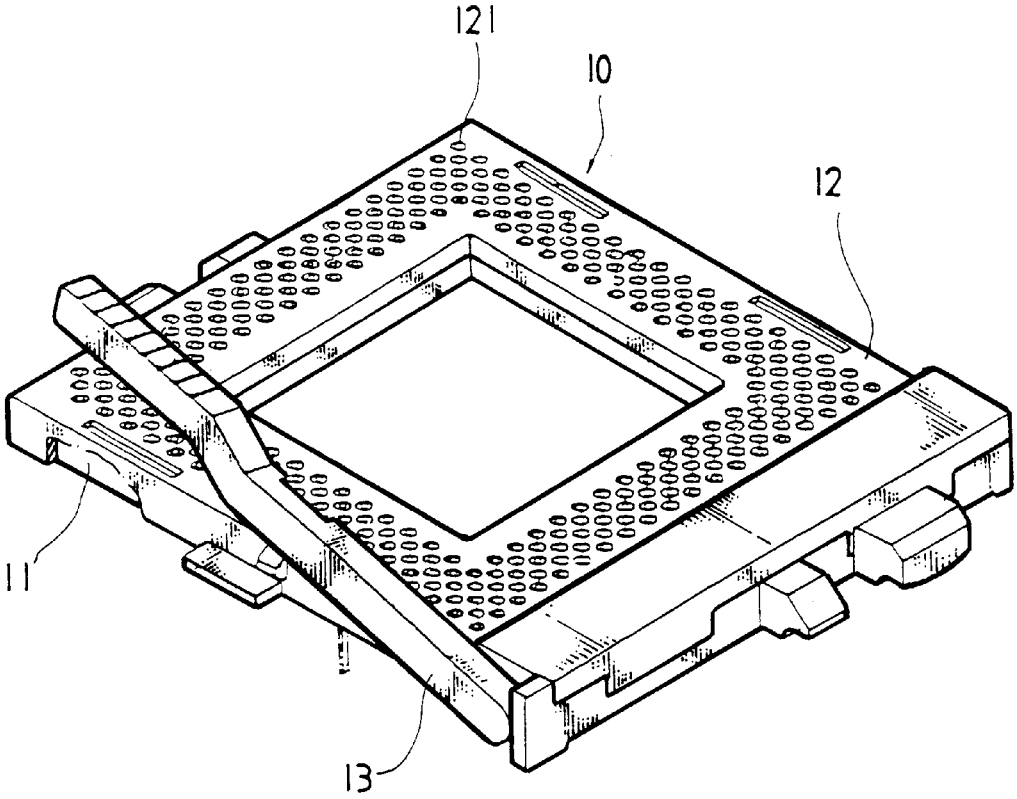
FIG. 3 is a perspective view of a CPU connector according to the present invention.

Referring to FIGS. 1 and 2 again, the terminal 20 comprises a flat, elongated mounting base 21, a leg 26 longitudinally extended from one end, namely, the bottom end of the mounting base 21, a flat first supporting arm 22 longitudinally extended from an opposite end, namely, the top end of the mounting base 21 reversed to the leg 26, a first side wing 211 and a second side wing 212 respectively extended from two opposite lateral sides of the bottom end of the mounting base 21 adjacent to the leg 26 in reversed directions, a third side wing 23 extended from one lateral side of one end, namely, the top end of the first supporting arm 22 remote from the mounting base 21 in direction same as the second side wing 212, a first guide portion 24 extended from one lateral side of the top end of the first supporting arm 22 opposite to the third side wing 23 and in direction same as the first side wing 211, a second guide portion 25 raised from one lateral side of the mounting base 21 and spaced between the first guide portion 24 and the first side wing 211, a raised portion 221 raised from a front side of the first supporting arm 22 between the third side wing 23 and the first guide portion 24, a second supporting arm 27 having a curved bottom end connected to one lateral side of the mounting base 21 above the second side wing 212 and a top end tilted upwardly inwards toward the first supporting arm 22, a spring strip 28 obliquely raised from the curved bottom end of the second supporting arm 27, a third guide portion 29 raised from the top end of the second supporting arm 27 and extended sideways in same direction as the first guide portion 24 and curved outwards, and a recessed guide face 291 at an inner side of the third guide portion 29 corresponding to the raised portion 221 at the first supporting arm 22.

Figure 5:
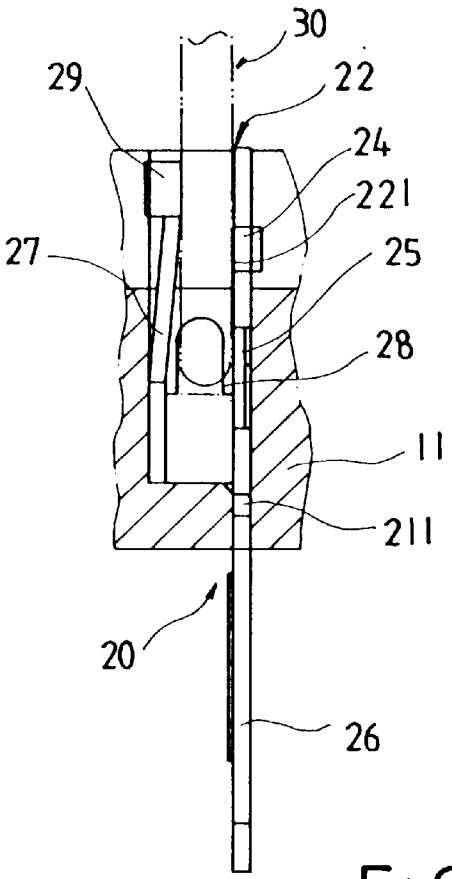
FIG. 5 is a side view of FIG. 4.
Figure 4:
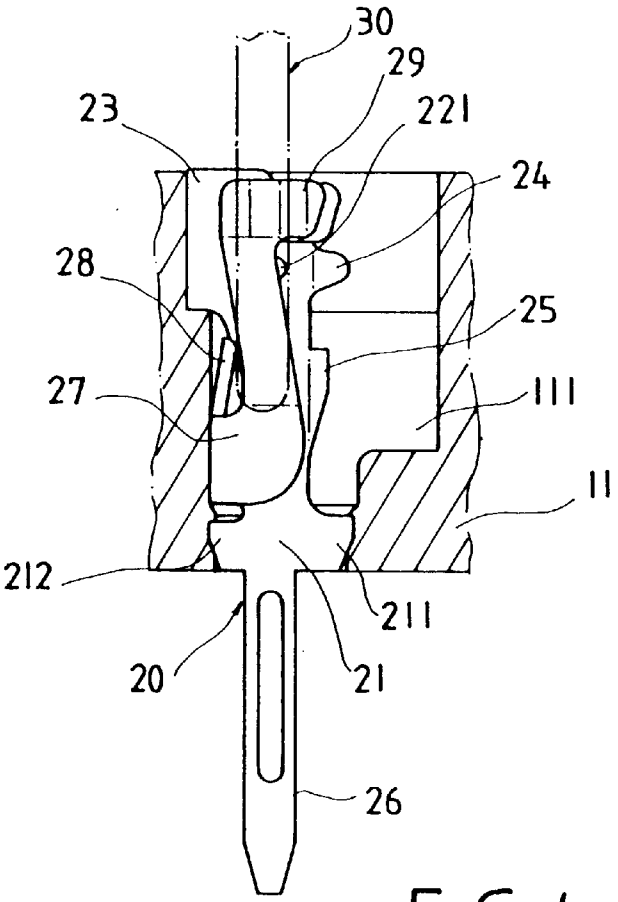
FIG. 4 is a front view in section showing the terminal installed in the terminal slot, the corresponding pin of the CPU retained to the terminal.
Figure 6:
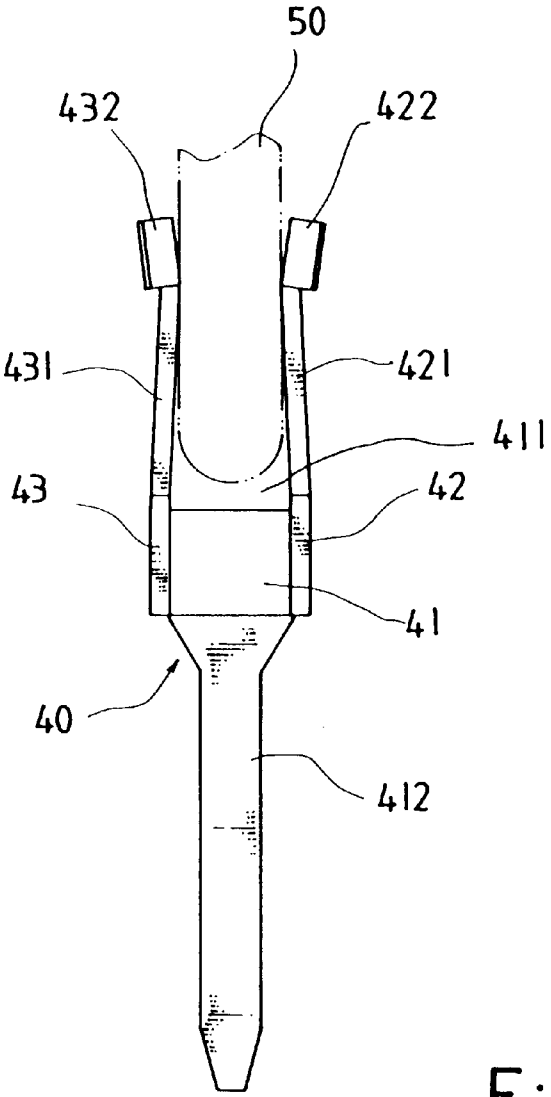
FIG 6 PRIOR ART
FIG. 6 is a sectional view of a terminal for a CPU connector according to the prior art.

Referring to FIGS. 4 and 5 and FIGS. 2 and 3 again, the terminals 20 are respectively inserted into the terminal slots 111 at the substrate 11 of the CPU connector 10 from the bottom side. By means of the guide of the first side wing 211 and the second side wing 212, each terminal 20 is positively inserted into position in the corresponding terminal slot 111. After insertion, the terminals 20 are positively positioned in the respective terminal slots 111 by the respective three side wings 211, 212 and 23, and the legs 26 of the terminals 20 are extended out of the bottom side wall of the substrate 11 for plugging into respective plug holes at a mother board (not shown). After the mounting of a CPU (not shown) on the cover plate 12 of the CPU connector 10 with its pins 30 respectively inserted into the insertion slots 121 at the cover plate 12, the lever 13 is operated to move the cover plate 12, enabling the pins 30 of the CPU to be respectively coupled to the terminals 20 in the terminal slots 111 at the substrate 11. When the pins 30 of the CPU are moved toward the terminals 20 in the terminal slots 111, each pin 30 is guided by the first guide portion 24, second guide portion 25 and third guide portion 29 of the corresponding terminal 20 into position and retained between the first supporting arm 22 and the second supporting arm 27. When the pin 30 is inserted into position, the spring strip 28 is compressed to impart a reactive force to the pin 30, causing the pin 30 to be held down against vibration, and at the same time the raised portion 221 at the first support arm 22 and the recessed guide face 291 at the third guide portion 29 are closely attached to the periphery of the pin 30 at two opposite sides (see FIGS. 2 and 5) to hold the pin 30 firmly in place. Further, when inserting the pins 30 into the terminal slots 111, the pins 30 may be tilted. However because the pins 30 are disposed in contact with the raised portions 221 of the terminals 20, the limited contact area between the raised portion 221 and the corresponding pin 30 produces little friction resistance. Therefore, the pins 30 can be inserted into position with less effort.

While only one embodiment of the present invention has been shown and described, it will be understood that various modifications and changes could be made thereunto without departing from the spirit and scope of the invention disclosed.

What the invention claimed is:

1. A terminal installed in one terminal slot at a substrate of a CPU connector for receiving a pin of a CPU mounted on the CPU connector, the terminal comprising a flat, elongated mounting base inserted into the terminal slot, a leg longitudinally extended from one end of said mounting base and protruded over the substrate for plugging into a plug hole at a mother board, a flat first supporting arm longitudinally extended from an opposite end of said mounting base reversed to said leg for supporting the pin of the CPU, a first side wing and a second side wing respectively extended from two opposite lateral sides of said mounting base adjacent to said leg and positioned in the terminal slot of the substrate, a third side wing extended from one lateral side of said first supporting arm remote from said mounting base in direction same as said second side wing and positioned in the terminal slot of the substrate, a first guide portion extended from one lateral side of said first supporting arm opposite to said third side wing and in direction same as said first side wing for guiding the pin of the CPU into position of engagement with the terminal, a second guide portion raised from one lateral side of said mounting base and spaced between said first guide portion and said first side wing for guiding the pin of the CPU into position of engagement with the terminal, a raised portion raised from one side of said first supporting arm between said third side wing and said first guide portion for contacting the periphery of the pin of the CPU, a second supporting arm having a curved bottom end connected to one lateral side of said mounting base above said second side wing and a top end tilted upwardly inwards toward said first supporting arm for contacting the periphery of the pin of the CPU, a spring strip obliquely raised from the curved bottom end of said second supporting arm for holding down the pin of the CPU, a third guide portion raised from one end of said second supporting arm remote from said mounting base and extended sideways in same direction as said first guide portion and having a recessed guide face for guiding the pin of the CPU into position of engagement with the terminal.

* * * * *